US007982562B2

(12) United States Patent
Yang et al.

(10) Patent No.: US 7,982,562 B2
(45) Date of Patent: Jul. 19, 2011

(54) MAGETIC LATCHING RELAY

(75) Inventors: Zheng Yang, Shanghai (CN); Zhongqin Wang, Shanghai (CN)

(73) Assignee: Shanghai BST Electrical Appliance Manufacturing Co., Ltd., Shanghai (CN)

( * ) Notice: Subject to any disclaimer, the term of this patent is extended or adjusted under 35 U.S.C. 154(b) by 320 days.

(21) Appl. No.: 12/199,889

(22) Filed: Aug. 28, 2008

(65) Prior Publication Data

US 2009/0058576 A1 Mar. 5, 2009

(30) Foreign Application Priority Data

Aug. 28, 2007 (CN) ..... 2007 2 0074176 U
Sep. 17, 2007 (CN) ..... 2007 2 0074746 U

(51) Int. Cl.
*H01H 51/22* (2006.01)

(52) U.S. Cl. ..... 335/78; 335/129; 335/133

(58) Field of Classification Search ..... 335/128–130, 335/78–86, 133
See application file for complete search history.

(56) References Cited

U.S. PATENT DOCUMENTS 4,060,847 A * 11/1977 Penrod ..... 361/705
4,272,746 A * 6/1981 Wright et al. ..... 335/128
7,659,800 B2 * 2/2010 Gruner et al. ..... 335/78
7,710,224 B2 * 5/2010 Gruner et al. ..... 335/78

* cited by examiner

*Primary Examiner* — Anh T Mai
*Assistant Examiner* — Bernard Rojas
(74) *Attorney, Agent, or Firm* — Matthias Scholl P.C.; Matthias Scholl

(57) ABSTRACT

The present invention relates to a magnetic latching relay which can avoid influences of erection stress on internal structure parameters thereof. The magnetic latching relay includes a yoke assembly, a magnetic steel assembly, a contact system having movable and immovable contact spring assemblies and a pusher pad, and a shell having a bottom case and an upper cover. Back contact springs of the movable contact spring assembly are arc-shaped and stacked on one side of each movable contact spring of the movable contact spring assembly. The bottom case has clip-shaped bosses which are formed outside two side walls of the bottom case to fasten extension ends of the movable and the immovable contact springs and supported with bolts to clamp the springs extending out of clip-shaped openings of the bosses.

5 Claims, 12 Drawing Sheets

MAGETIC LATCHING RELAY

CROSS-REFERENCE TO RELATED APPLICATIONS

This application claims priority benefits to Chinese Patent Application No. 200720074176.7 filed Aug. 28, 2007and Chinese Patent Application No. 200720074746.2 and Sep. 17, 2007. The contents of all of the aforementioned specifications are incorporated herein by reference.

BACKGROUND OF THE INVENTION

1. Field of the Invention

The present invention is related to basic electric elements, and more especially to a relay.

2. Description of the Related Art

A relay includes a yoke assembly, a magnetic steel assembly, a contact system and a shell. The yoke assembly is composed of coils and yokes. The magnetic steel assembly is an integrated one including a cylindrical shaft, a magnetic steel and a plastic armature, and the cylindrical shaft is installed in an axle hole defined by a bottom case of the shell and a tongue-shaped or triangular supporting frame that is plug-connected with a locating and dividing slot board of the magnetic steel assembly inside the shell. The contact system includes movable and immovable contact spring assemblies and a pusher pad that has a slot for insertion of the movable contact spring assembly. There is an obround trepan hole in a front end of the pusher pad for engaging with a push pin which is installed on a pin boss interconnected with a plastic mold envelope of the magnetic steel assembly. One end of each contact spring of the contact system is extended outside the bottom case and connected into an external circuit via bolts. The shell consists of the bottom case and an upper cover, and is shaped approximately like a rectangular case, with locating and dividing slots arranged inside the bottom case according to partitioned part installation area. The relay overcomes the defect that the magnetic steel assembly and the contact system are obstructed by an original rectangular supporting frame and the problem that assembling quality of the magnetic circuit assembly is hard to control for the magnetic latching relay, but the influences of erection stress on internal structural parameters shall be avoided when mounting an electric meter for satisfying requirements of future popularization.

The movable contact spring assembly is one major element in the contact system of the relay. Normally the movable contact spring assembly includes a movable contact spring with a contact at one end and a movable contact spring seat inserted inside the shell of the relay, both of which are connected by three rivets. The contact is arranged in a foreside of the movable contact assembly, and a riveting section on a root of the movable contact spring is connected with that of the movable contact spring seat by lap riveting. Because the movable contact spring is linearly extended in an extension direction of the riveting section of the movable contact spring seat, a long installation section is required inside the shell. In order to fulfill requirements of current density and low power consumption, many back contact springs with partially round arch or "U" shaped convex bends are stacked close to a rear side of the movable contact spring, and front ends of the back contact springs and the movable contact spring are overlapped for riveting the contact, moreover their roots overlapped for being riveted by rivets. Previously the round arch-shaped bends are large and have an unsteady flexibility. Structural pattern of the movable contact spring assembly shall be appropriate and perfect if possible due to its relation to reliability of the contact system of the relay.

SUMMARY OF THE INVENTION

An object of the present invention is to provide a magnetic latching relay which avoids influences of erection stress on internal structural parameters thereof by perfecting a movable contact spring assembly and relevant structures.

To achieve the above-mentioned object, a magnetic latching relay in accordance with the present invention is disclosed. The magnetic latching relay includes a yoke assembly, a magnetic steel assembly, a contact system having movable and immovable contact spring assemblies and a pusher pad, and a shell having a bottom case and an upper cover. Back contact springs of the movable contact spring assembly are arc-shaped and stacked on one side of each movable contact spring of the movable contact spring assembly. The bottom case has clip-shaped bosses which are formed outside two side walls of the bottom case to fasten extension ends of the movable and the immovable contact springs and supported with bolts to clamp the springs extending out of clip-shaped openings of the bosses.

The present invention avoids large occupied space and unsteady flexibility caused by projection of the back contact springs due to the integral arc shape of the back contact springs of the movable contact spring assembly. Many back contact springs of the present invention are stacked for conducting high current and achieving low power consumption and good action flexibility. Through the improvement of the structure outside both side walls of the bottom case of the shell of the magnetic latching relay, the springs of the extended boss are well-clamped so as to avoid the influences of erection stress on the internal structural parameters of the magnetic latching relay when the contact spring projects from the magnetic latching relay as inserts of an electric meter. The present invention is especially applicable for two-phase 200 A magnetic latching relays, favoring their popularization.

DETAILED DESCRIPTION OF THE INVENTION

Figure 1:
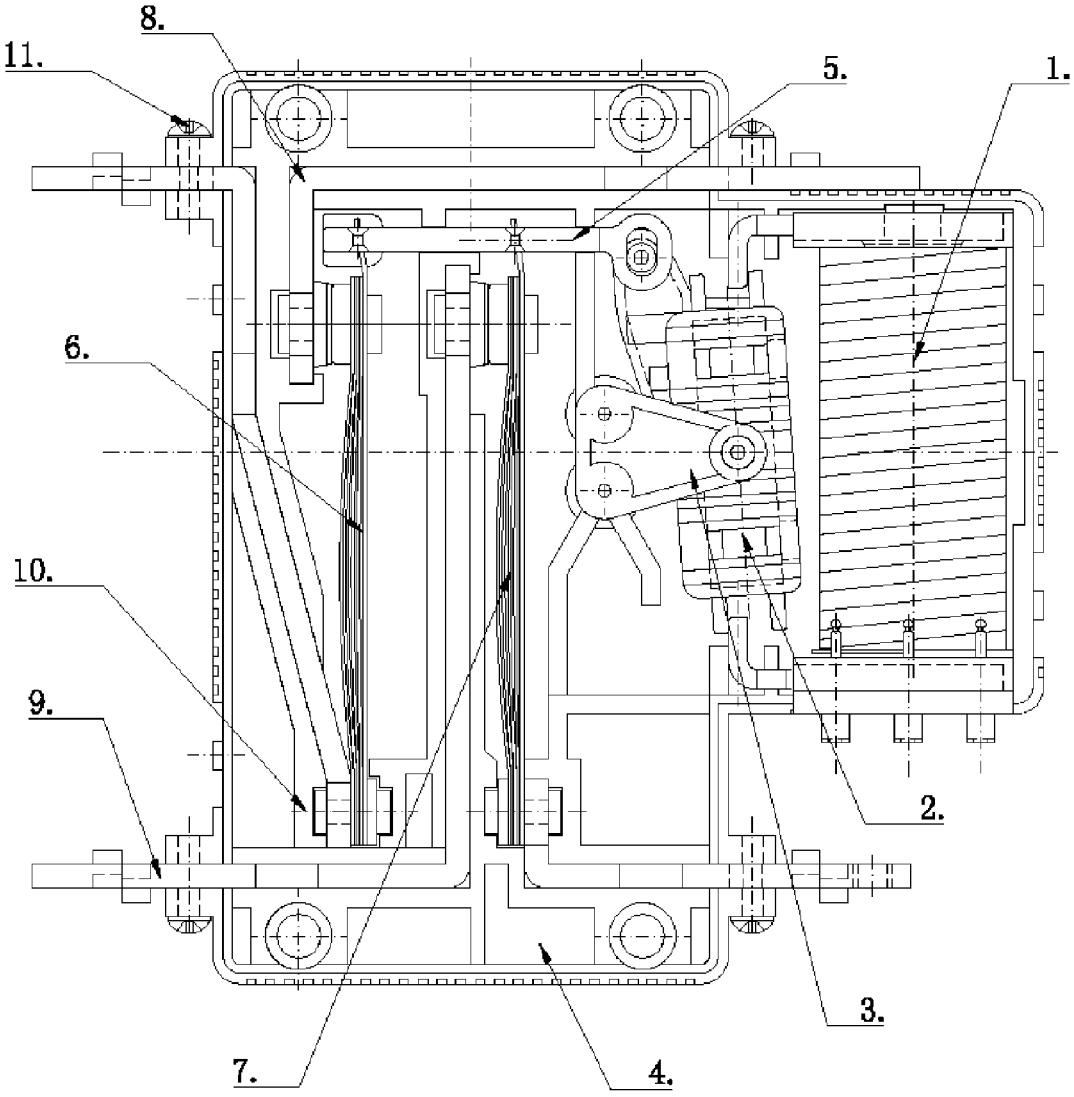
FIG. 1 is an assembled view of a magnetic latching relay according to the present invention.

As shown in FIG. 1, a magnetic latching relay according to the present invention includes a yoke assembly 1, a magnetic steel assembly 2, a contact system and a shell 4. The yoke assembly 1 includes a single coil or double coils, and double yokes. For the double coils, if electrified by any phase of three-phase power, the relay will normally work, and overlapped opening and shutdown signals only lead to non-operation of the relay thereby avoiding disaster caused by short circuit between the phases. This is the greatest advantage of two drive coils, which is hardly achieved by a single drive coil.

The magnetic steel assembly 2 is an integrated one including a cylindrical shaft, a magnetic steel and a plastic armature. A supporting frame 3 for mounting the shaft of the magnetic steel assembly 2 is tongue-shaped or triangular. A pin in a rearside of supporting frame 3 is plug-connected with a tubular jack on a partitioned locating and dividing slot board of the magnetic steel assembly inside the shell. A shaft hole is arranged on a foreside of the tongue-shaped or triangular supporting frame 3 for installing the shaft of the magnetic steel assembly 2.

Figure 13:
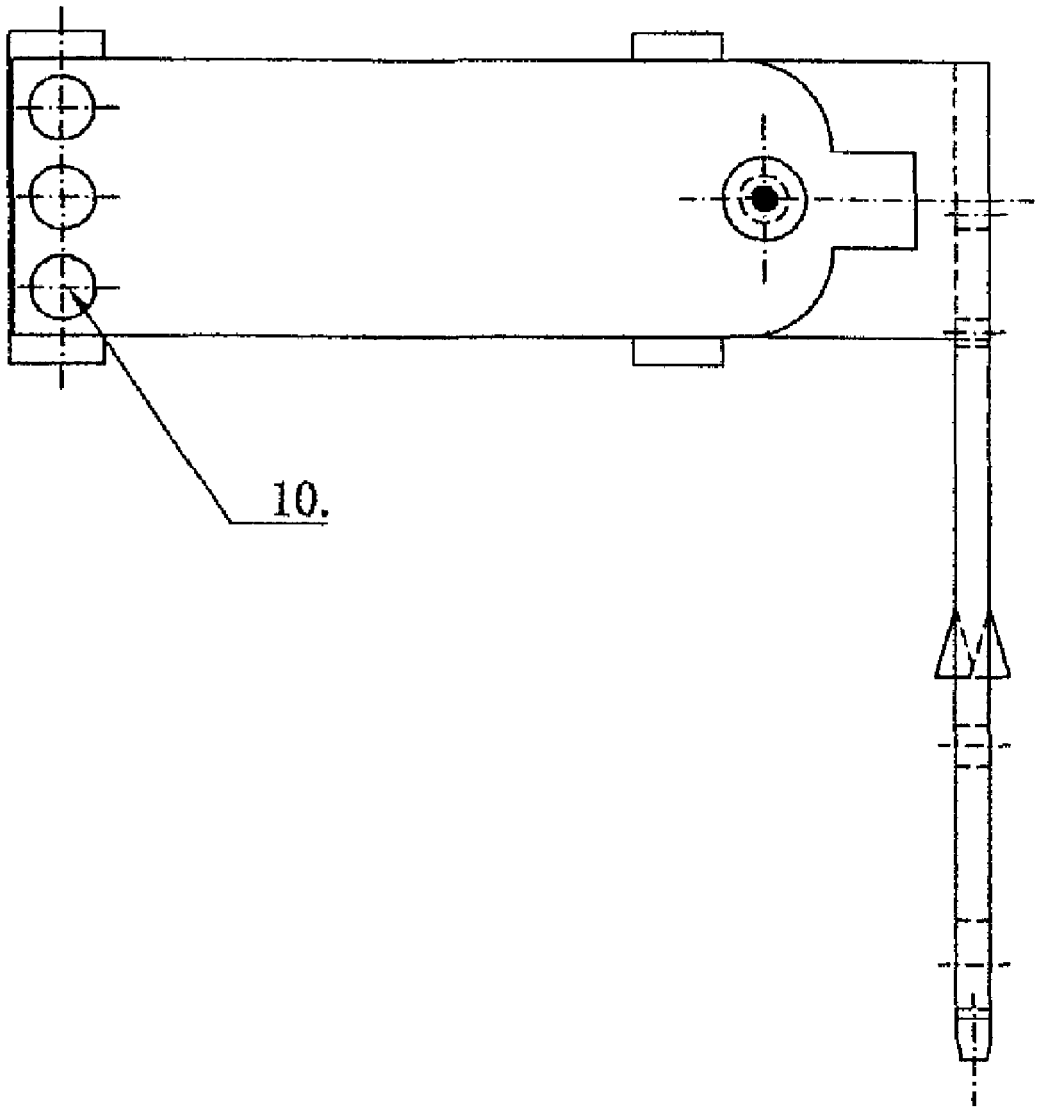
FIG. 13 is a right view of the movable contact spring assembly in FIG. 12.
Figure 14:
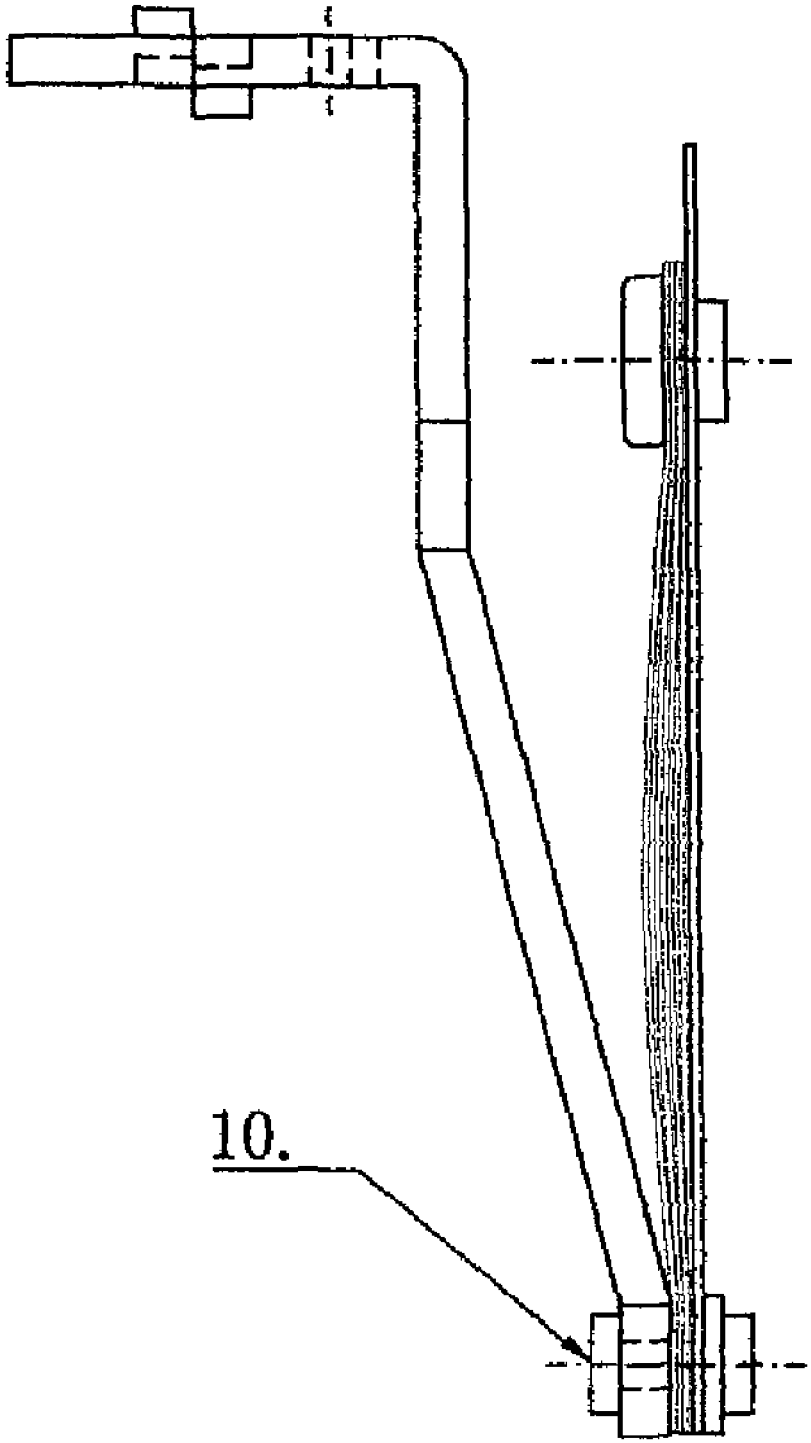
FIG. 14 is a top view of the movable contact spring assembly in FIG. 12.

A movable contact spring assembly of the contact system includes a contact spring with a contact at one end and a contact spring which extends along locating and dividing slots inside a bottom case and projects outside the shell of the relay, and both of the contact springs are connected by rivets 10 (as shown in FIGS. 1, 13, and 14). The movable contact springs 6, 7 are connected with a main part of a movable contact spring seat in the shape of turnback or right angle for reduced length of the contact spring assembly and structural compaction, favoring the reduced size of the relay. There are 2-4 back contact springs stacked on one side of each movable contact spring, which increase conductive cross-sectional area and flexibility. Front ends of the movable and the back contact springs are overlapped for riveting the contacts; and roots of the movable and the back contact springs and the movable contact spring seat are connected with three rivets so as to obtain a steady connection. The main parts of the back contact springs are arc-shaped. The best size of each back contact spring is as follows: Length 59.5 mm, width 20 mm, thickness 0.3±0.02 mm; one section of 7.6 mm longitudinal length on the root of each back contact spring constitutes the riveting part connected to a curved surface of 42 mm length, and the distance between a center of an outer arc of the main part of each back contact spring and a corresponding chord is 1.2 mm; three Φ2.6 mm rivet holes are arranged on a center line 3.5 mm below the lower root of each back contact spring for riveting the movable contact spring seat with the movable contact spring; and one Φ3.5 mm rivet hole is arranged 51±0.05 mm apart from center lines of the three rivet holes of each back contact spring for riveting the contact with the movable contact spring.

Table 1 indicates the flexibility test data of the movable contact spring assembly of the present invention; and Table 2 gives the flexibility test data of the "U"-shaped movable contact spring.

TABLE 1

| Items | Values | | | | |
|---|---|---|---|---|---|
| Displacement (mm) | 0.2 | 0.4 | 0.6 | 0.8 | 1 |
| Resistance (N) | 1 | 1.4 | 2 | 2.6 | 3.2 |
| Flexibility (mm/N) | 0.2 | 0.286 | 0.3 | 0.31 | 0.31 |

TABLE 2

| Items | Values | | | | |
|---|---|---|---|---|---|
| Displacement (mm) | 0.2 | 0.4 | 0.6 | 0.8 | 1 |
| Resistance (N) | 1.2 | 2.0 | 2.9 | 3.7 | 4.9 |
| Flexibility (mm/N) | 0.17 | 0.2 | 0.21 | 0.22 | 0.2 |

Shown from Tables 1 and 2, the movable contact spring assembly of the present invention has a larger flexibility more than previous "U"-shaped ones.

Figure 9:
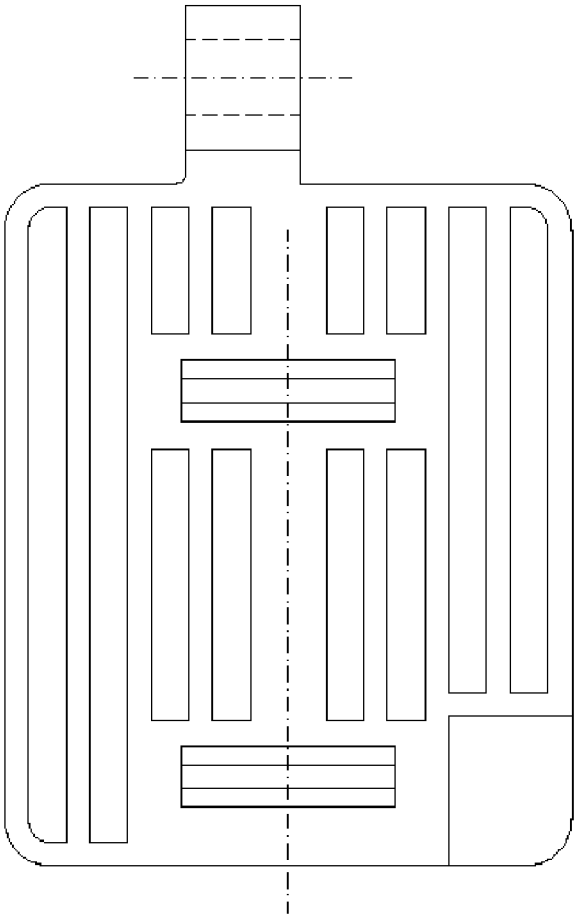
FIG. 9 is a front view of a pusher pad of a contact system of the magnetic latching relay according to the present invention.
Figure 10:
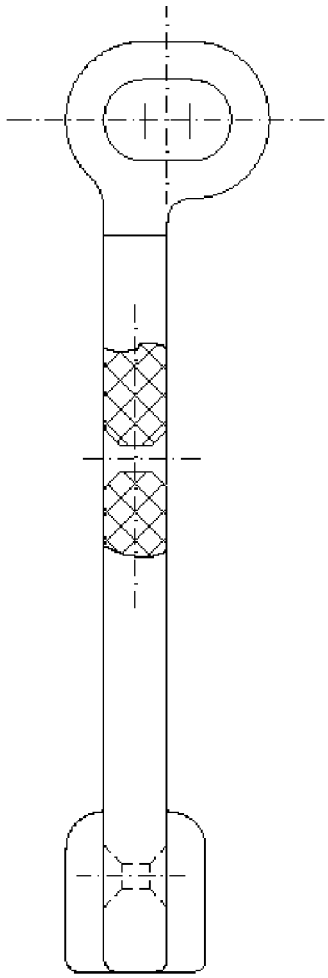
FIG. 10 is a left view of the pusher pad of the contact system in FIG. 9.
Figure 11:
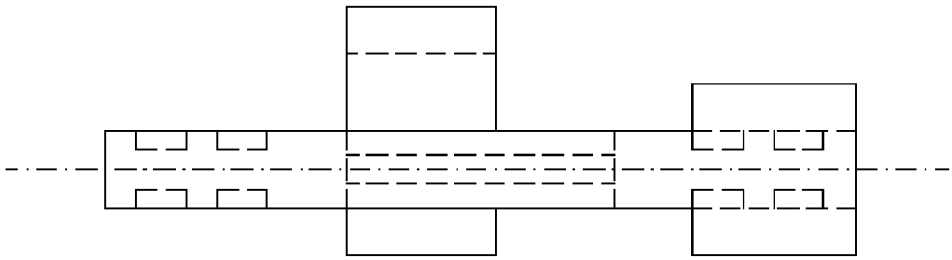
FIG. 11 is a bottom view along lines A-A in FIG. 9.
Figure 12:
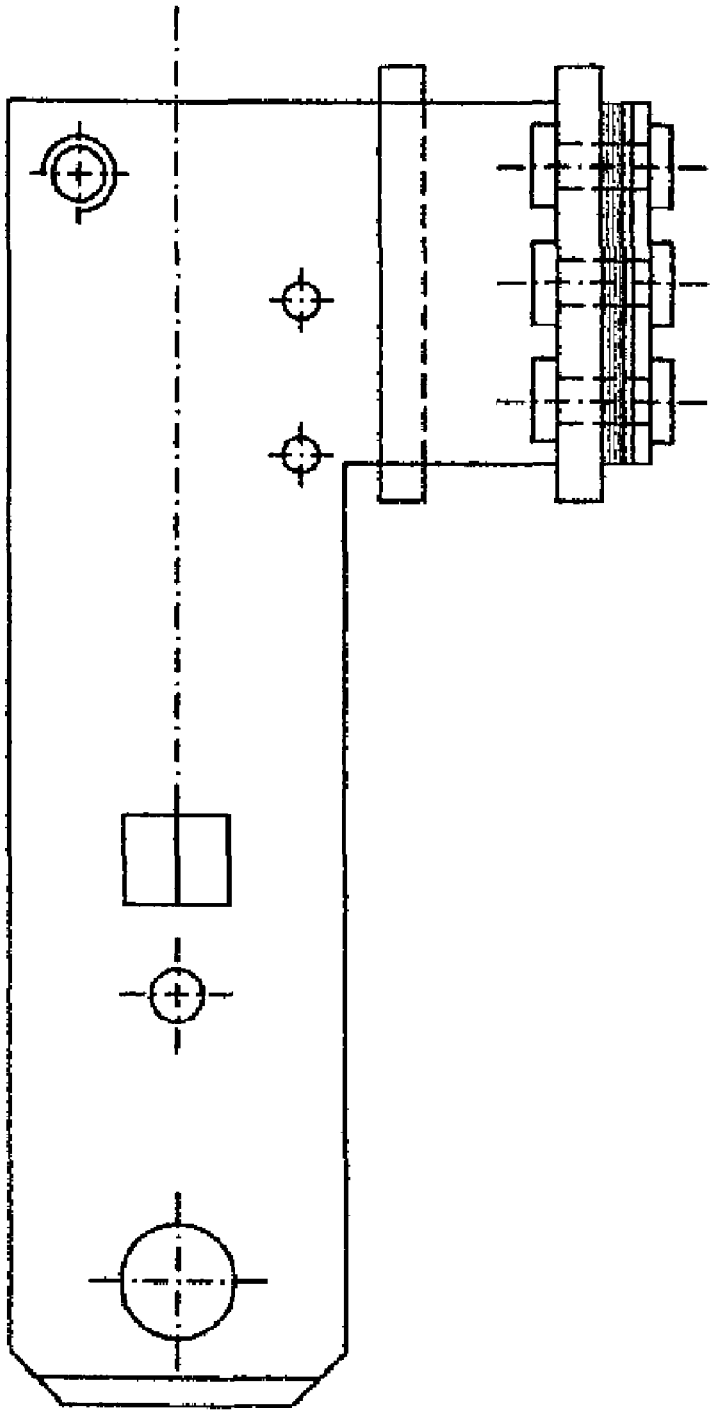
FIG. 12 is a view of a movable contact spring assembly of the magnetic latching relay according to the present invention.

Contact springs 8, 9 of an immovable contact spring assembly (as shown in FIG. 1) have contacts at one end, and project outside the shell along the locating and dividing slots inside the bottom case. The movable contact springs 6, 7 are interlinked by a pusher pad 5 inside the shell 4. There are two long holes arranged on the pusher pad 5 (as shown in FIGS. 9, 10, and 11), and ends of the movable contact springs 6, 7 are locked by the long holes of the pusher pad 5 so as to control the on-off operation of the contacts of the movable and the immovable contact springs accurately. There is an obround trepan hole in one end of the pusher pad 5 for a push pin installed on a pin boss that is interconnected with a plastic mold envelope of the magnetic steel assembly. A lower follow-up end of the pusher pad 5 is thickened to be in the shape of flange, and the thickened end ensures that the pusher pad 5 is not easy to deviate for steady and accurate motion. The back contact springs of the movable and the immovable contact spring assemblies are projected through a side wall of the shell 4 (as shown in FIGS. 1, 2, 3, 4, 5, and 6) to satisfy installation requirements, and are fabricated as rectangular inserts in the form of electric meter inserts (see FIGS. 3 and 12).

Figure 2:
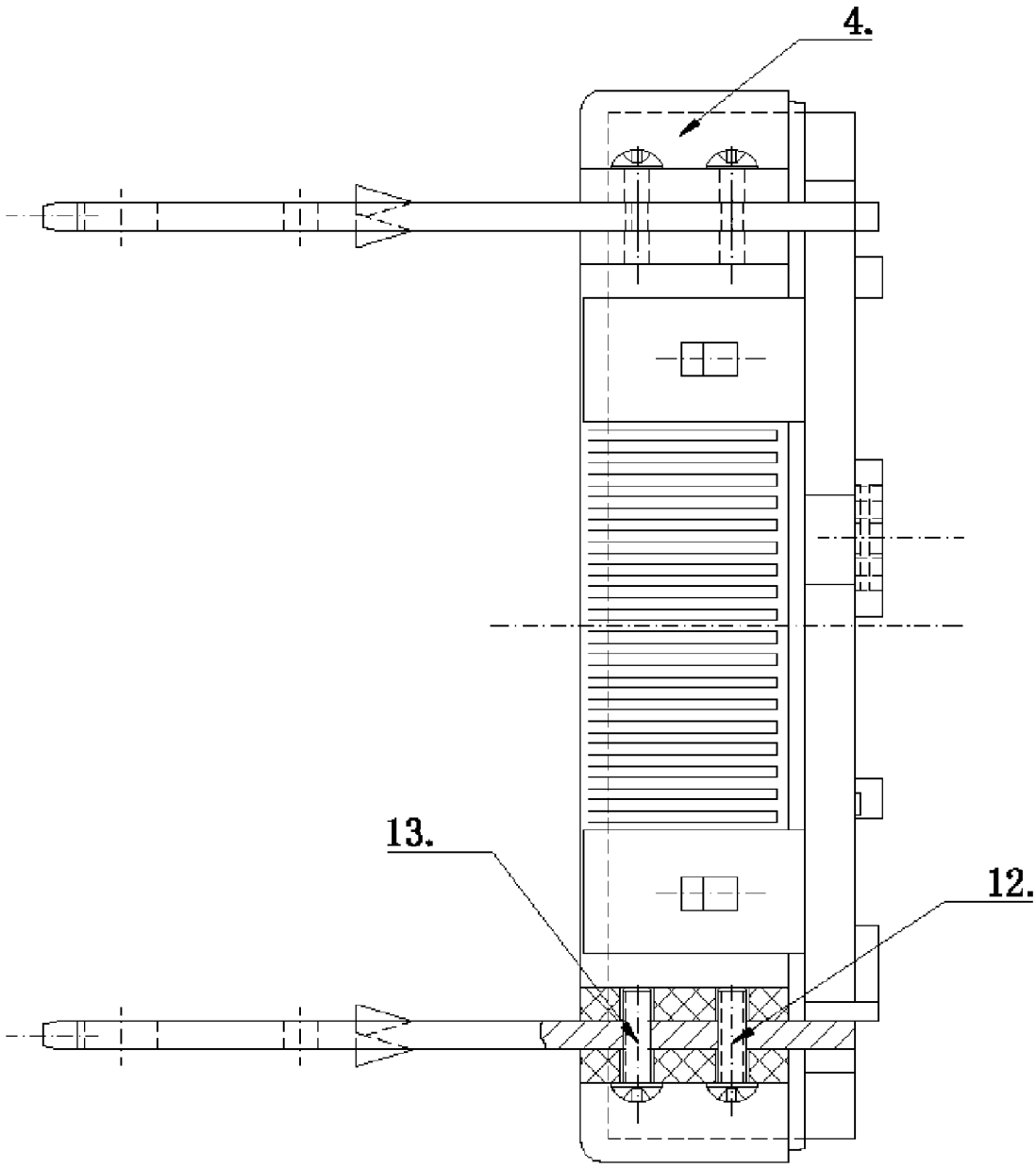
FIG. 2 is a left view of the magnetic latching relay in FIG. 1.
Figure 3:
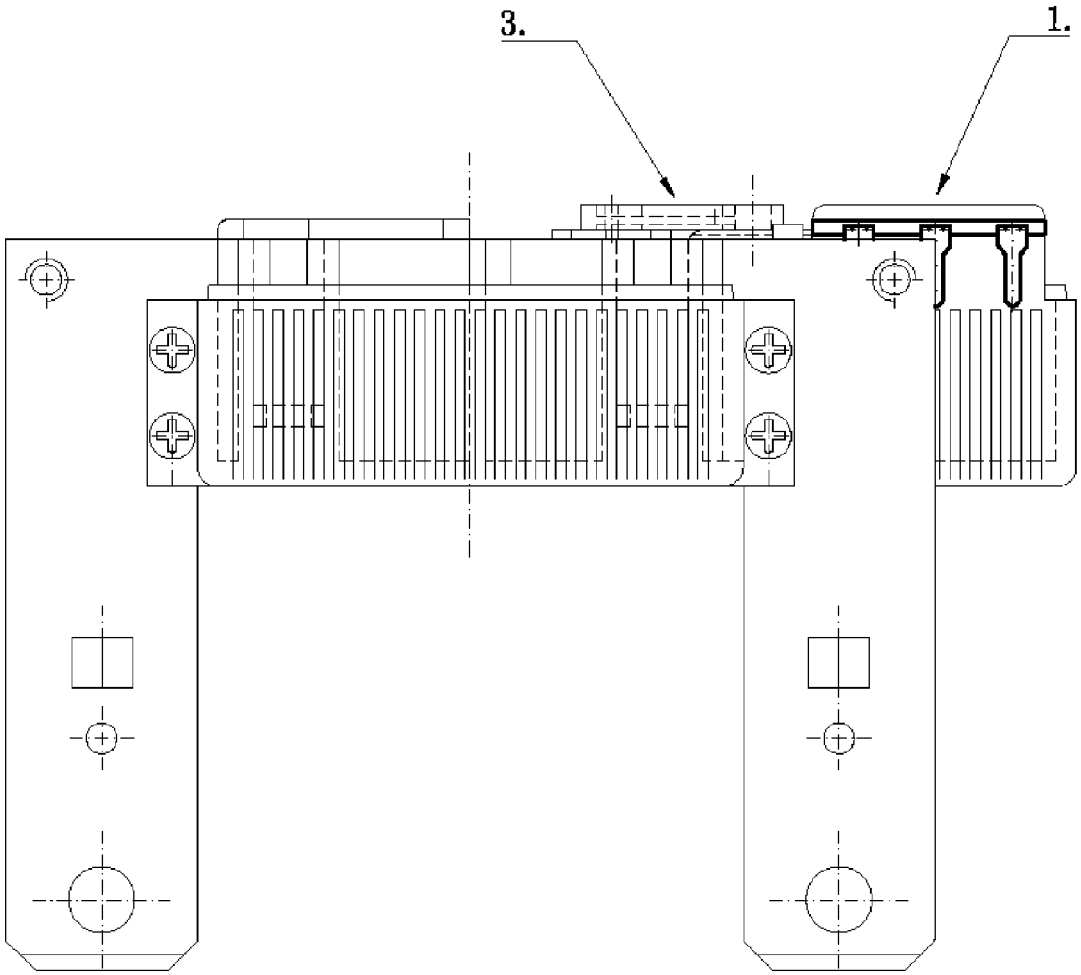
FIG. 3 is a top view of the magnetic latching relay in FIG. 1.
Figure 4:
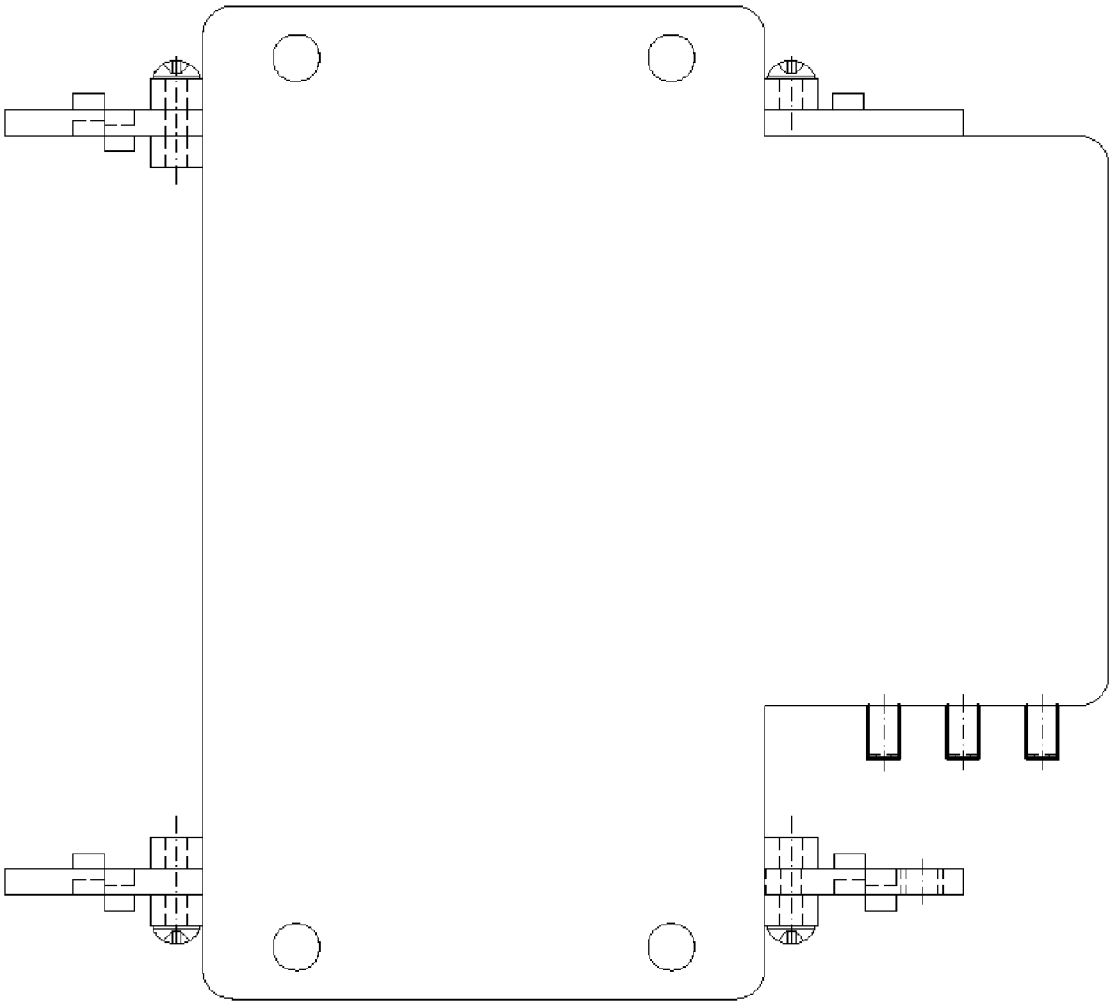
FIG. 4 is a front view showing the shape of the magnetic latching relay assembled with an upper cover.
Figure 5:
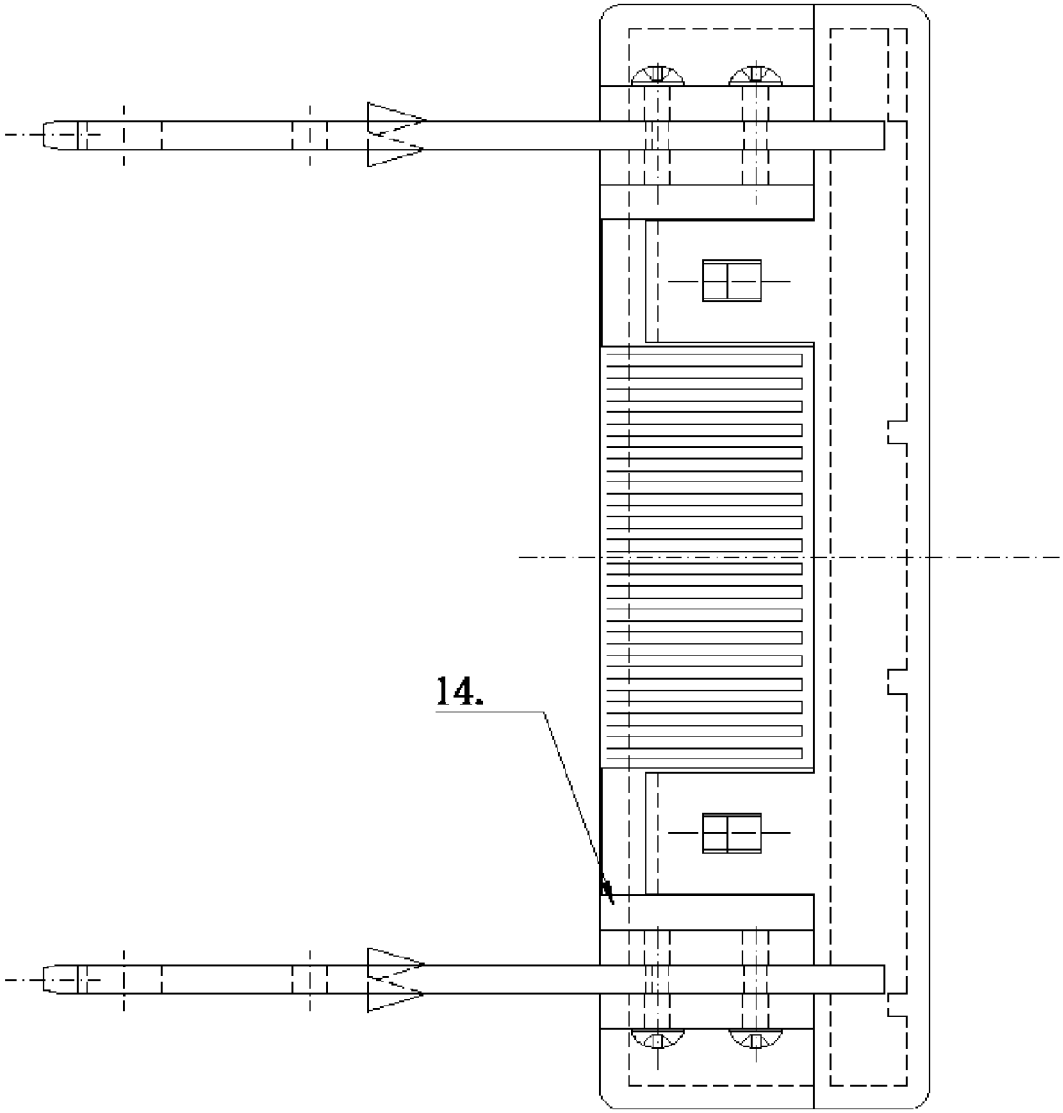
FIG. 5 is a left view of the magnetic latching relay assembled with the upper cover in FIG. 4.
Figure 6:
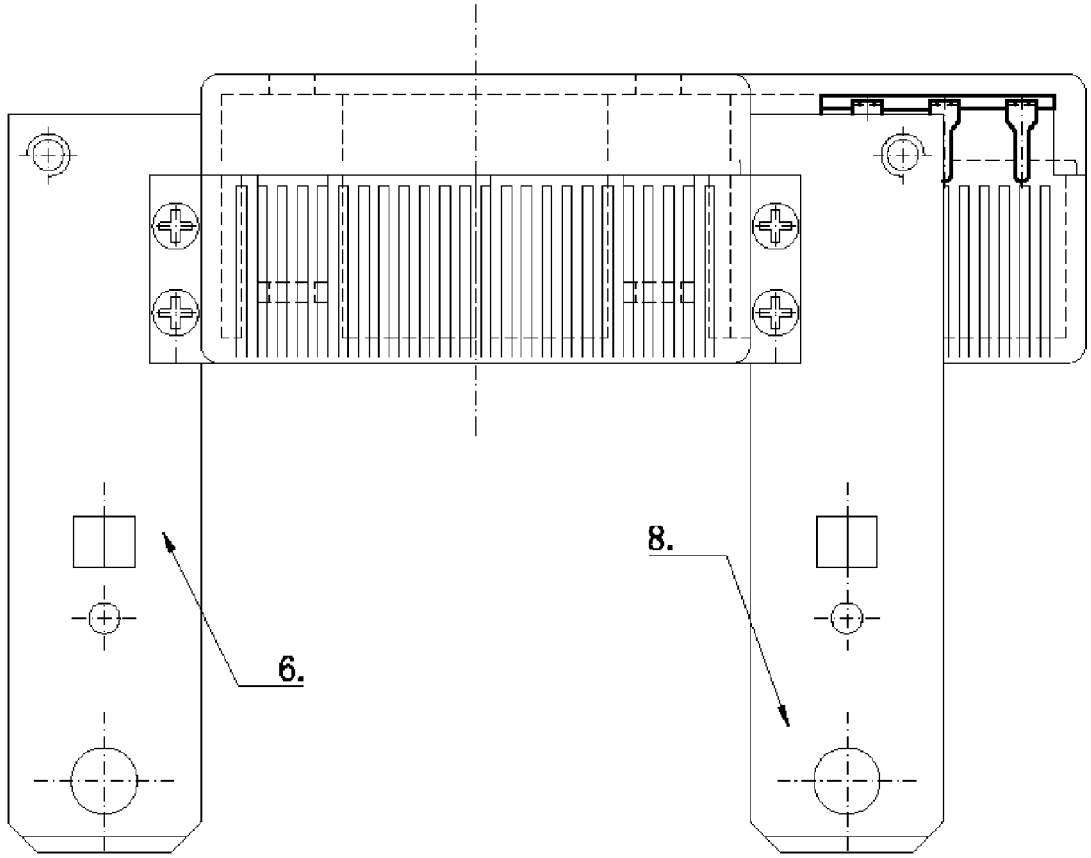
FIG. 6 is a top view of the magnetic latching relay assembled with the upper cover in FIG. 4.
Figure 7:
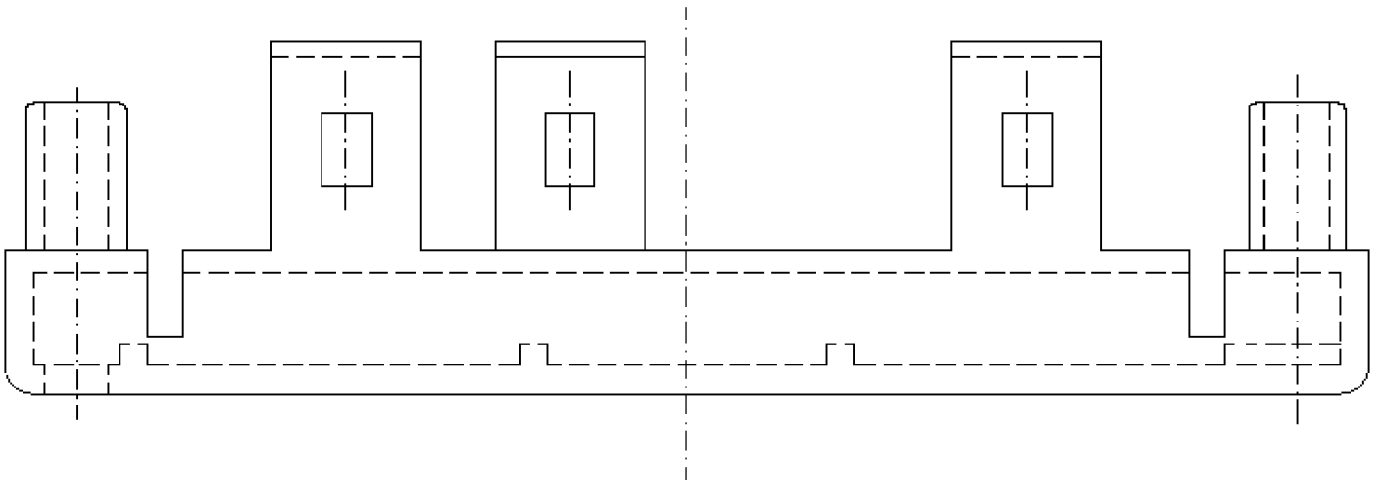
FIG. 7 is a left view of the upper cover of the shell of the magnetic latching relay according to the present invention.
Figure 8:
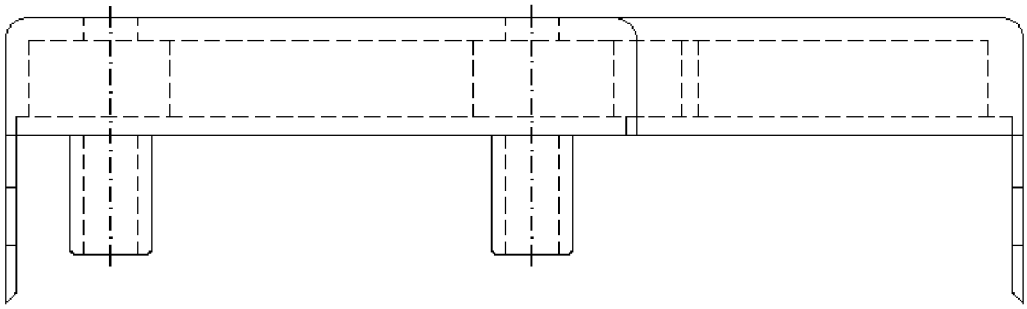
FIG. 8 is a bottom view of the upper cover of the shell of the magnetic latching relay according to the present invention.

The shell 4 is assembled with the bottom case (as shown in FIGS. 1, 2, and 3) and an upper cover (as shown in FIGS. 4, 7, and 8). The shell 4 is in the shape of two interconnected boxes (one large and high, one small and low), and round holes for installation are arranged in four corners of the larger rectangular box of the shell 4 (as shown in FIG. 4). Clip-shaped bosses 11 are formed outside two side walls of the bottom case to fasten the extension ends of the movable and the immovable contact springs, and supported with bolts 12, 13 to clamp the springs extending out of clip-shaped openings of the bosses 11. An outside wall of shell 4 is ridge-shaped to reinforce the outside wall and improve heat elimination of an electric meter; embedded parts in side surfaces of the bottom case and the upper cover are assembled with slots and rectangular ridge buckles 14, respectively (as shown in FIGS. 2 and 7). The locating and dividing slots are arranged inside the box of the bottom case according to elements installed. The contact system and the yoke assembly are installed in the lower and higher sides of the box respectively, and the magnetic steel assembly is installed between the contact system and the yoke assembly.

What is claimed is:

1. A magnetic latching relay, comprising:

a yoke assembly;

a magnetic steel assembly;

a contact system, comprising a movable contact spring assembly having back contact springs, an immovable contact spring assembly and a pusher pad; and a shell, comprising a bottom case having clip-shaped bosses, and an upper cover;

wherein said clip-shaped bosses are formed outside two side walls of said bottom case to fasten extension ends of said movable contact springs and immovable contact springs of said immovable contact spring assembly;

said clip-shaped bosses are supported with bolts to clamp the springs extending out of said clip-shaped bosses; and each back contact spring is 59.5 mm long, 20 mm wide and 03±0.02 thick; one section of 7.6 mm longitudinal length on a root of each back contact spring constitutes a riveting part connected to a curved surface of 42 mm length; a distance between a center of an outer arc of the main part of each back contact spring and a corresponding chord is 1.2 mm; three Φ2.6 mm rivet holes are arranged on a center line 3.5 mm below a lower root of each back contact spring; one Φ3.5 mm rivet hole is arranged 51±0.05 mm apart from center lines of the three rivet holes of the back contact spring for riveting the contact with the movable contact spring.

2. A magnetic latching relay, comprising:

a yoke assembly;

a magnetic steel assembly;

a contact system, comprising a movable contact spring assembly having back contact springs, an immovable contact spring assembly and a pusher pad; and a shell, comprising a bottom case having clip-shaped bosses, and an upper cover;

wherein said clip-shaped bosses are formed outside two side walls of said bottom case to fasten extension ends of said movable contact springs and immovable contact springs of said immovable contact spring assembly;

said clip-shaped bosses are supported with bolts to clamp the springs extending out of said clip-shaped bosses;

said back contact springs are arc-shaped;

said movable contact spring assembly stacked on one side of each movable contact spring; and each back contact spring is 59.5 mm long, 20 mm wide and 0.3±0.02 thick; one section of 7.6 mm longitudinal length on a root of each back contact spring constitutes a riveting part connected to a curved surface of 42 mm length; a distance between a center of an outer arc of the main part of each back contact spring and a corresponding chord is 1.2 mm; three Φ2.6 mm rivet holes are arranged on a center line 3.5 mm below a lower root of each back contact spring; one Φ3.5 mm rivet hole is arranged 51±0.05 mm apart from center lines of the three rivet holes of the back contact spring for riveting the contact with the movable contact spring.

3. A magnetic latching relay, comprising:

a yoke assembly;

a magnetic steel assembly;

a contact system, comprising a movable contact spring assembly having back contact springs, an immovable contact spring assembly and a pusher pad; and a shell, comprising a bottom case having clip-shaped bosses, and an upper cover;

wherein said clip-shaped bosses are formed outside two side walls of said bottom case to fasten extension ends of said movable contact springs and immovable contact springs of said immovable contact spring assembly;

said clip-shaped bosses are supported with bolts to clamp the springs extending out of said clip-shaped bosses;

said movable contact spring and a main part of a movable contact spring seat are connected in the shape of turn-back or right angle; and each back contact spring is 59.5 mm long, 20 mm wide and 0.3±0.02 thick;

one section of 7.6 mm longitudinal length on a root of each back contact spring constitutes a riveting part connected to a curved surface of 42 mm length; a distance between a center of an outer arc of the main part of each back contact spring and acorresponding chord is 1.2 mm; three Φ2.6 mm rivet holes are arranged on a center line 3.5 mm below a lower root of each back contact spring; one Φ3.5 mm rivet hole is arranged 51±0.05 mm apart from center lines of the three rivet holes of the back contact spring for riveting the contactwith the movable contact spring.

4. The magnetic latching relay of claim 3, wherein the springs extending outside the shell are right angle shaped.

5. The magnetic latching relay of claim 4, wherein the pusher pad has a lower follow-up end thickened to be in the shape of flange.

* * * * *